US011193188B2

(12) United States Patent
Xie et al.

(10) Patent No.: US 11,193,188 B2
(45) Date of Patent: Dec. 7, 2021

(54) NITRIDING OF NIOBIUM STEEL AND PRODUCT MADE THEREBY

(71) Applicant: NUCOR CORPORATION, Charlotte, NC (US)

(72) Inventors: Yuxuan Xie, Auburn (AU); Chen Zhu, Redfern (AU); Julie M. Cairney, Petersham (AU); Simon P. Ringer, Hulstone Park (AU); Christopher R. Killmore, Wollongong (AU); Frank Barbaro, Thirroul (AU); James Williams, Balgownie (AU)

(73) Assignee: Nucor Corporation, Charlotte, NC (US)

( * ) Notice: Subject to any disclaimer, the term of this patent is extended or adjusted under 35 U.S.C. 154(b) by 156 days.

(21) Appl. No.: 16/202,473

(22) Filed: Nov. 28, 2018

(65) Prior Publication Data

US 2019/0100827 A1 Apr. 4, 2019

Related U.S. Application Data

(60) Division of application No. 13/030,170, filed on Feb. 18, 2011, now abandoned, which is a (Continued)

(51) Int. Cl.
*C22C 38/02* (2006.01)
*C21D 1/06* (2006.01)
(Continued)

(52) U.S. Cl.
CPC ..... *C22C 38/02* (2013.01); *C21D 1/06* (2013.01); *C21D 8/02* (2013.01); *C22C 38/001* (2013.01);
(Continued)

(58) Field of Classification Search
None
See application file for complete search history.

(56) References Cited

U.S. PATENT DOCUMENTS 4,067,754 A 1/1978 Elias et al.
4,073,643 A 2/1978 Kumai et al.
(Continued)

FOREIGN PATENT DOCUMENTS

AT 313402 T 1/2006
AU 744196 B2 2/2002
(Continued)

OTHER PUBLICATIONS

Knerr, et al. "Gas Nitriding." ASM Handbook, vol. 4: Heat Treating. pp. 387-409. 1991. (Year: 1991).*
(Continued)

*Primary Examiner* — Brian D Walck
(74) *Attorney, Agent, or Firm* — Hahn Loeser & Parks LLP

(57) ABSTRACT

A nitrided steel product or thin cast steel strip comprising, by weight, less than 0.25% carbon, between 0.20 and 2.0% manganese, between 0.05 and 0.50% silicon, less than 0.01% aluminum, niobium between 0.01 and about 0.20%, and between 0.01 and 0.075% nitrogen, and having a majority of the microstructure comprised of bainite and acicular ferrite, having more than 70% niobium in solid solution prior to nitriding and having yield strength between 650 MPa and 800 MPa and tensile strength between 750 MPa and 900 MPa.

14 Claims, 5 Drawing Sheets

Related U.S. Application Data continuation-in-part of application No. 12/709,133, filed on Feb. 19, 2010, now Pat. No. 10,071,416.

(60) Provisional application No. 61/306,471, filed on Feb. 20, 2010, provisional application No. 61/154,231, filed on Feb. 20, 2009.

(51) Int. Cl.

| | |
|---|---|
| ***C21D 8/02*** | (2006.01) |
| ***C22C 38/00*** | (2006.01) |
| ***C22C 38/04*** | (2006.01) |
| ***C22C 38/06*** | (2006.01) |
| ***C22C 38/12*** | (2006.01) |
| ***C23C 8/02*** | (2006.01) |
| ***C23C 8/26*** | (2006.01) |
| ***C23C 8/38*** | (2006.01) |
| ***C23C 8/50*** | (2006.01) |

(52) U.S. Cl.

CPC ..... *C22C 38/04* (2013.01); *C22C 38/06* (2013.01); *C22C 38/12* (2013.01); *C23C 8/02* (2013.01); *C23C 8/26* (2013.01); *C23C 8/38* (2013.01); *C23C 8/50* (2013.01)

(56) References Cited

U.S. PATENT DOCUMENTS

| | | | | |
|---|---|---|---|---|
| 4,082,576 | A | | 4/1978 | Lake et al. |
| 4,152,140 | A | | 5/1979 | Hori et al. |
| 4,468,249 | A | | 8/1984 | Lehman |
| 4,534,805 | A | | 8/1985 | Jesseman |
| 4,745,786 | A | | 5/1988 | Wakako et al. |
| 4,746,361 | A | | 5/1988 | Pielet et al. |
| 4,832,757 | A | | 5/1989 | Cox et al. |
| 4,851,052 | A | | 7/1989 | Nishioka et al. |
| 5,184,668 | A | | 2/1993 | Fukase et al. |
| 5,277,243 | A | | 1/1994 | Fukase et al. |
| 5,488,988 | A | | 2/1996 | Fukase et al. |
| 5,667,605 | A | | 9/1997 | Bellus et al. |
| 5,720,336 | A | | 2/1998 | Strezov |
| 5,934,359 | A | | 8/1999 | Strezov |
| 5,985,051 | A | | 11/1999 | Yamamoto et al. |
| 6,059,014 | A | | 5/2000 | Strezov |
| 6,073,679 | A | | 6/2000 | Strezov |
| 6,083,455 | A | | 7/2000 | Kurita et al. |
| 6,110,296 | A | * | 8/2000 | Zaranek ..... C21D 8/0415 148/225 |
| 6,129,791 | A | | 10/2000 | Nakajima et al. |
| 6,358,338 | B1 | | 3/2002 | Guelton et al. |
| 6,364,967 | B1 | | 4/2002 | Yamamoto et al. |
| 6,488,790 | B1 | | 12/2002 | Hartmann et al. |
| 6,491,089 | B1 | | 12/2002 | Poirier et al. |
| 6,502,626 | B1 | | 1/2003 | Mascanzoni et al. |
| 6,547,849 | B2 | | 4/2003 | Gross et al. |
| 6,558,486 | B1 | | 5/2003 | Strezov et al. |
| 6,588,494 | B1 | | 7/2003 | Mazurier et al. |
| 6,663,725 | B2 | | 12/2003 | Inoue et al. |
| 6,818,073 | B2 | | 11/2004 | Strezov et al. |
| 6,855,218 | B1 | | 2/2005 | Kawalla et al. |
| 6,939,415 | B2 | | 9/2005 | Iseda et al. |
| 6,942,013 | B2 | | 9/2005 | Strezov et al. |
| 7,252,722 | B2 | | 8/2007 | Nakajima et al. |
| 2003/0111206 | A1 | | 6/2003 | Blejde et al. |
| 2003/0185700 | A1 | | 10/2003 | Ishii et al. |
| 2004/0177944 | A1 | | 9/2004 | Blejde et al. |
| 2004/0177945 | A1 | | 9/2004 | Blejde et al. |
| 2008/0219879 | A1 | | 9/2008 | Williams et al. |
| 2009/0277546 | A1 | | 11/2009 | Hammer et al. |
| 2010/0043513 | A1 | | 2/2010 | Hammer et al. |
| 2010/0065161 | A1 | | 3/2010 | Hammer et al. |
| 2010/0065162 | A1 | | 3/2010 | Hammer et al. |
| 2010/0096047 | A1 | | 4/2010 | Hammer et al. |

FOREIGN PATENT DOCUMENTS

| | | | |
|---|---|---|---|
| AU | 2005200300 | A1 | 8/2005 |
| AU | 2001291499 | B2 | 2/2007 |
| BE | 875003 | A | 7/1979 |
| BR | 9810193 | | 8/2000 |
| BR | 0114338 | B1 | 2/2012 |
| CA | 2284124 | A1 | 9/1998 |
| CA | 2294333 | A1 | 12/1998 |
| CA | 2420492 | A1 | 4/2002 |
| CN | 1260740 | A | 7/2000 |
| CN | 1458870 | A | 11/2003 |
| CZ | 293823 | B6 | 8/2004 |
| DE | 265641 | A1 | 3/1989 |
| DE | 69832886 | | 1/2006 |
| EP | 0040553 | A1 | 11/1981 |
| EP | 0732163 | A2 | 9/1996 |
| EP | 0800881 | A2 | 10/1997 |
| EP | 1143022 | A1 | 10/2001 |
| EP | 1493832 | A1 | 1/2005 |
| EP | 1007248 | B1 | 12/2005 |
| EP | 1399598 | B2 | 2/2011 |
| JP | S57130750 | A | 8/1982 |
| JP | S57134249 | A | 8/1982 |
| JP | S5831026 | A | 2/1983 |
| JP | S58113318 | A | 7/1983 |
| JP | 58193319 | A | 11/1983 |
| JP | S62050054 | A | 3/1987 |
| JP | S64017824 | A | 1/1989 |
| JP | H02160145 | A | 6/1990 |
| JP | H02179343 | A | 7/1990 |
| JP | H02179843 | A | 7/1990 |
| JP | H02205618 | A | 8/1990 |
| JP | H03249126 | A | 11/1991 |
| JP | H03249128 | A | 11/1991 |
| JP | H03291139 | A | 12/1991 |
| JP | H05017821 | A | 1/1993 |
| JP | H05289549 | A | 11/1993 |
| JP | H08053714 | A | 2/1996 |
| JP | H08188847 | A | 7/1996 |
| JP | H08281382 | A | 10/1996 |
| JP | H08294751 | A | 11/1996 |
| JP | H10219392 | A | 8/1998 |
| JP | H11061253 | A | 3/1999 |
| JP | H11158538 | A | 6/1999 |
| JP | H11350064 | A | 12/1999 |
| JP | 2000178634 | A | 6/2000 |
| JP | 2001502974 | A | 3/2001 |
| JP | 2001123245 | A | 5/2001 |
| JP | 2001152255 | A | 6/2001 |
| JP | 2001342543 | A | 12/2001 |
| JP | 2001355039 | A | 12/2001 |
| JP | 2003138340 | A | 5/2003 |
| JP | 2003147477 | A | 5/2003 |
| JP | 2004018971 | A | 1/2004 |
| JP | 2004508942 | A | 3/2004 |
| JP | 2004211157 | A | 7/2004 |
| KR | 20010013946 | A | 2/2001 |
| KR | 20010075195 | A | 8/2001 |
| KR | 20020040210 | A | 5/2002 |
| KR | 20020048034 | A | 6/2002 |
| KR | 20020048199 | A | 6/2002 |
| KR | 20030064760 | A | 8/2003 |
| MX | PA03001971 | A | 9/2004 |
| PL | 186657 | B1 | 2/2004 |
| RU | 2212976 | C2 | 9/2003 |
| SK | 181499 | A3 | 3/2001 |
| TR | 199903146 | T2 | 7/2000 |
| UA | 61113 | C2 | 8/2000 |
| WO | 9412300 | A1 | 6/1994 |
| WO | 9513155 | A1 | 5/1995 |
| WO | 9513889 | A1 | 5/1995 |
| WO | 9828450 | A1 | 7/1998 |
| WO | 9855251 | A1 | 12/1998 |
| WO | 9857767 | A1 | 12/1998 |
| WO | 0007753 | A1 | 2/2000 |
| WO | 0120051 | A1 | 3/2001 |
| WO | 0226422 | A1 | 4/2002 |

(56) References Cited

FOREIGN PATENT DOCUMENTS

| | | | |
|---|---|---|---|
| WO | 2004005572 | A1 | 1/2004 |
| WO | 2008054166 | A1 | 5/2008 |
| WO | 2010094077 | A1 | 8/2010 |

OTHER PUBLICATIONS

Lake et al., Partially Annealed High Strength Cold Rolled Steels, Biblioteheek T.U.E. ADM., Nov. 7, 2005, pp. 1-12, Society of Automotive Engineers, Inc.
Y.Z. Shen, K.H. Oh, D.N. Lee; Nitrogen strengthening of interstitial-free steel by nitriding in potassium nitrate salt bath; Materials Science and Engineering A 434 (2006); pp. 314-318.
Gault et al, "Advances in the calibration of atom probe tomographic reconstruction", J. Appl. Phys. 105, 034913 (2009).
PCT/AU2011/00171 International Search Report, dated May 23, 2011, 3 pages.
Kelvin Y. Xie, Sachin L. Shrestha, Peter J. Felfer, Julie M. Cairney, Chris R. Killmore, Kristin R. Carpenter, Harold R. Kaul, Simon P. Ringer; High Strength and Retained Ductility Achieved in a Nitrided Strip Case NB-Microalloyed Steel; Metallurgical and Materials Transactions; Feb. 2013; pp. 848-855; vol. 44A.
AU2010904022 International-Type Search Report, dated Oct. 8, 2010, 3 pages.
Klaus Hulka, Niobium Products Company GmbH, Dusseldorf, Germany, The Role of Niobium in Low Carbon Bainitic HSLA Steel, Oct. 2005.
Recent Development in Project M the Joint Development of Low Carbon Steel Strip Casting by BHP and IHI, presented at the METEC Congress 99, Dusseldorf Germany (Jun. 13-15, 1999), p. 176-181.
Schwinn, V.; Fluess, P.; Ormston, D. Low Carbon Bainitic TMCP Plate tor Structural and Line-Pipe Application. In Recent Advances of Niobium Containing Materials in Europe; Hulka, K., Klinkenburg, C., Mohrbacher, H., Eds.; Verlag Stahleisen GmbH: Dusseldorf, Germany, 2005; pp. 45-57.
Schneider et al., Titanium-Bearing High Strength Cold Rolled Steels, Proceedings of the 22nd Mechanical Working & Steel Processing Conference XVIII, Oct. 29-30, 1980, pp. 398-429, Toronto, Ontario.
Bordignon et al., High Strenth Low-Allow Steels for Automotive Applications, Niobium Technical Report, NbTR-06/84, Dec. 1984 ISSN-0101-5963.
Constitution and properties of Steels, Materials Science and Technology, 1992, pp. 49, 272, 273, 337, 350, 351, vol. 7, VCH Verlagsgesellschaft mbH, Federal Republic of Germany.
Krauss et al., "Ferritic Microstructures in Continuously Cooled Low- and Ultralow- carbon steels", ISIJ International (The Iron and Steel Institute of Japan), vol. 35, No. 8 (1995), pp. 937-945.
Penning et al., The development of recovery annealed steels, International Journal of Materials and Product Technology, 1995, vol. 10, Nr. 3-6, pp. 325-337, Inderscience Engerprises Ltd.
Maugis et al., European Commission, Technocal Steel Research, Physical metallurgy of rolling and finishing, Development of methods for the characterization and modeling of precipitation in steels, Jul. 1, 1999 to Jun. 30, 2002, Contract No. 7210-PR/160, Final Report, pp. 20, 21, 23, 25, 42, 45, 46, 48, 51, 84, 139, 140, 187, 188, 190, 191, 205, 206, 209, 212, European Communities, 2004, Luxembourg.
Ludlow et al., European Commission, Technical Steel Research, Casting, reheating and direct rolling, Precipitation of nitrides and carbides during solidification and cooling, Contract No. 7210-PR/213, Jul. 1, 2000 to Jun. 30, 2004, Final Report, pp. 43, 135-137, 140, 141, 144, 145, 147-149, 152, 154, 155, 197, 245, 247, 277, 289, European Communities, 2006, Luxembourg.
Bhadeshia, H.K.D.H., 'Bainite in Steels' 2nd edition, Chapter 13: Modern Baintic Steels, pp. 343-396, published by the Institute of Materials, Minerals and Mining, Mar. 2001.
Z. Rogalski, Z. Katas; Mechanical Properties and Corrosion Resistance of Nitrided or Oxinitrided, and Powder Painted Regular and Interstitial Free (IF) Drawing Steel Sheet; Mat.-wiss. u. Werkstofftech. 2004, 35, No. 6; pp. 394-400.

* cited by examiner

NITRIDING OF NIOBIUM STEEL AND PRODUCT MADE THEREBY

CROSS-REFERENCE TO RELATED APPLICATIONS

This patent application is a divisional of U.S. patent application Ser. No. 13/030,170, filed on Feb. 18, 2011, which claims priority to and benefit of U.S. Provisional Patent Application Ser. No. 61/306,471, filed on Feb. 20, 2010, and is a continuation-in-part of U.S. patent application Ser. No. 12/709,133, filed Feb. 19, 2010, now U.S. Pat. No. 10,071,416, which claims priority to and benefit of U.S. Provisional Patent Application Ser. No. 61/154,231, filed Feb. 20, 2009, the disclosures of which are hereby incorporated by reference in their entirety.

BACKGROUND AND SUMMARY

This invention relates to making of high strength thin cast strip, and the method for making such cast strip by a twin roll caster.

In a twin roll caster, molten metal is introduced between a pair of counter-rotated, internally cooled casting rolls so that metal shells solidify on the moving roll surfaces, and are brought together at the nip between them to produce a solidified strip product, delivered downwardly from the nip between the casting rolls. The term "nip" is used herein to refer to the general region at which the casting rolls are closest together. The molten metal is poured from a ladle through a metal delivery system comprised of a tundish and a core nozzle located above the nip to form a casting pool of molten metal, supported on the casting surfaces of the rolls above the nip and extending along the length of the nip. This casting pool is usually confined between refractory side plates or dams held in sliding engagement with the end surfaces of the rolls so as to dam the two ends of the casting pool against outflow.

In the past, high-strength low-carbon thin strip with yield strengths of 60 ksi (413 MPa) and higher, in strip thicknesses less than 3.0 mm, have been made by recovery annealing of cold rolled strip. Cold rolling was required to produce the desired thickness. The cold roll strip was then recovery annealed to improve the ductility without significantly reducing the strength. However, the final ductility of the resulting strip still was relatively low and the strip would not achieve total elongation levels over 6%, which is required for structural steels by building codes for structural components. Such recovery annealed cold rolled, low-carbon steel was generally suitable only for simple forming operations, e.g., roll forming and bending. To produce this steel strip with higher ductility was not technically feasible in these final strip thicknesses using the cold rolled and recovery annealed manufacturing route.

In the past, high strength, low carbon steel strip have also been made by microalloying with elements such as niobium, vanadium, titanium or molybdenum, and hot rolling to achieve the desired thickness and strength level. Such microalloying required expensive and high levels of niobium, vanadium, titanium or molybdenum and resulted in formation of a bainite-ferrite microstructure typically with 10 to 20% bainite. See U.S. Pat. No. 6,488,790. Alternately, the microstructure could be ferrite with 10-20% pearlite. Hot rolling the strip resulted in the partial precipitation of these alloying elements. As a result, relatively high alloying levels of the Nb, V, Ti or Mo elements were required to provide enough precipitation hardening of the predominately ferritic transformed microstructure to achieve the required strength levels. These high microalloying levels significantly raised the hot rolling loads needed and restricted the thickness range of the hot rolled strip that could be economically and practically produced. Such alloyed high strength strip could be directly used for galvanizing after pickling for the thicker end of the product range greater than 3 mm in thickness.

However, making of high strength, low carbon steel strip less than 3 mm in thickness with microalloying additions of Nb, V, Ti or Mo to the base steel chemistry was very difficult, particularly for wide strip due to the high rolling loads, and not always commercially feasible. For lower thicknesses of strip, cold rolling was required; however, the high strength of the hot rolled strip made such cold rolling difficult because of the high cold roll loadings required to reduce the thickness of the strip. These high alloying levels also considerably raised the recrystallization annealing temperature needed, requiring expensive to build and operate annealing lines capable of achieving the high annealing temperature needed for full recrystallization annealing of the cold rolled strip.

In short, the application of previously known microalloying practices with Ni, V, Ti or Mo elements to produce high strength thin strip could not be commercially produced economically because of the high alloying costs, difficulties with high rolling loads in hot rolling and cold rolling, and the high recrystallization annealing temperatures required.

Twin roll casting has enabled development of both plain C steel and Nb-microalloyed steel thin cast strip. An as-received 0.084 wt % Nb-microalloyed steel has been able to produced having a yield strength of 475 MPa with 14% total elongation. Previous studies have shown that with developed compositions, Nb atoms stay in the matrix as a solid solution with relatively fast cooling rate which can be achieved with twin roll casting. C and N contents in these steel compositions are quite low (0.031 and 0.007 wt % respectively) and the thickness of the as-hot-rolled steel sheets can be around 1.1 mm, so rapid diffusion of N into the steel composition is possible. We have found that the Nb-microalloyed steel properties can be further improved by nitriding.

Presently disclosed is a nitrided steel product comprised, by weight, less than 0.25% carbon, between 0.20 and 2.0% manganese, between 0.05 and 0.50% silicon, less than 0.01% aluminum, niobium between 0.01 and about 0.20%, and between 0.01 and 0.075% nitrogen. The steel product has a majority of the microstructure comprised of bainite and acicular ferrite, with more than 70% niobium in solid solution prior to nitriding. The yield strength is between 650 MPa and 800 MPa and the tensile strength is between 750 MPa and 900 MPa.

Alternatively or additionally, the niobium content may be less than 0.1% by weight. The nitrogen content may be between 0.035 and 0.065% by weight or alternatively may be between 0.045 and 0.065% by weight.

The nitrided steel product may have a yield strength on at least 40% greater than a similar steel composition without nitriding. Alternatively or additionally, the nitrided steel product may have a tensile strength of at least 30% greater than a similar steel composition without nitriding. The yield strength may be between 650 MPa and 750 MPa, and the tensile strength may be between 750 MPa and 850 MPa. The nitrided steel product may have a total elongation of less than 25%, and additionally, the total elongation may be at least 1%, or alternatively, at least 6% or at least 10%.

In addition, a nitrided thin cast steel strip of less than 3 millimeters in thickness comprises, by weight, less than 0.25% carbon, between 0.20 and 2.0% manganese, between 0.05 and 0.50% silicon, less than 0.01% aluminum, niobium between 0.01 and about 0.20%, and between 0.01 and 0.075% nitrogen. The nitrided thin cast steel strip has a majority of the microstructure comprised of bainite and acicular ferrite, with more than 70% niobium in solid solution prior to nitriding. The yield strength is between 650 MPa and 800 MPa and the tensile strength is between 750 MPa and 900 MPa.

Alternatively or additionally, the niobium content may be less than 0.1% by weight. The nitrogen content may be between 0.035 and 0.065% by weight or alternatively may be between 0.045 and 0.065% by weight.

The nitrided thin cast steel strip may have a yield strength on at least 40% greater than a similar steel composition without nitriding. Alternatively or additionally, the nitrided thin cast steel strip may have a tensile strength of at least 30% greater than a similar steel composition without nitriding. The yield strength may be between 650 MPa and 750 MPa, and the tensile strength may be between 750 MPa and 850 MPa.

The nitrided thin cast steel strip may have a total elongation of less than 25%, and additionally, the total elongation may be at least 1%, or alternatively, at least 6% or at least 10%. Further, the thin cast steel strip may have a thickness in the range from about 0.5 mm to about 2 mm.

The nitrided thin cast steel strip may in addition comprise fine oxide particles of silicon and iron distributed through the steel microstructure having an average particle size less than 50 nanometers.

Additionally, a nitrided hot rolled steel product of less than 3 millimeters thickness comprises, by weight, less than 0.25% carbon, between 0.20 and 2.0% manganese, between 0.05 and 0.50% silicon, less than 0.01% aluminum, niobium between 0.01% and 0.20%, and between 0.01 and 0.075% nitrogen, and having a majority of the microstructure comprised of bainite and acicular ferrite and having yield strength between 650 MPa and 800 MPa and tensile strength between 750 MPa and 900 MPa.

Alternatively or additionally, the niobium content may be less than 0.1% by weight. The nitrogen content may be between 0.035 and 0.065% by weight or alternatively may be between 0.045 and 0.065% by weight.

The nitrided hot rolled steel product may have a yield strength on at least 40% greater than a similar steel composition without nitriding. Alternatively or additionally, the nitrided hot rolled steel product may have a tensile strength of at least 30% greater than a similar steel composition without nitriding. The yield strength may be between 650 MPa and 750 MPa, and the tensile strength may be between 750 MPa and 850 MPa.

The nitrided hot rolled steel product may have a total elongation of less than 25%, and additionally, the total elongation may be at least 1%, or alternatively, at least 6% or at least 10%. Further, the nitrided hot rolled steel product may have a thickness in the range from about 0.5 mm to about 2 mm.

The nitrided hot rolled steel product may in addition comprise fine oxide particles of silicon and iron distributed through the steel microstructure having an average particle size less than 50 nanometers.

Additionally, a nitrided cold rolled steel product of less than 3 millimeters thickness comprises, by weight, less than 0.25% carbon, between 0.20 and 2.0% manganese, between 0.05 and 0.50% silicon, less than 0.01% aluminum, niobium between 0.01% and 0.20%, and between 0.01 and 0.075% nitrogen, and having a majority of the microstructure comprised of bainite and acicular ferrite and having yield strength between 650 MPa and 800 MPa and tensile strength between 750 MPa and 900 MPa.

Alternatively or additionally, the niobium content of the cold rolled steel product may be less than 0.1% by weight. The nitrogen content may be between 0.035 and 0.065% by weight or alternatively may be between 0.045 and 0.065% by weight.

The nitrided cold rolled steel product may have a yield strength on at least 40% greater than a similar steel composition without nitriding. Alternatively or additionally, the nitrided cold rolled steel product may have a tensile strength of at least 30% greater than a similar steel composition without nitriding. The yield strength may be between 650 MPa and 750 MPa, and the tensile strength may be between 750 MPa and 850 MPa.

The nitrided cold rolled steel product may have a total elongation of less than 25%, and additionally, the total elongation may be at least 1%, or alternatively, at least 6% or at least 10%. Further, the nitrided cold rolled steel product may have a thickness in the range from about 0.5 mm to about 2 mm.

The nitrided cold rolled steel product may in addition comprise fine oxide particles of silicon and iron distributed through the steel microstructure having an average particle size less than 50 nanometers.

Also disclosed is a nitrided age hardened steel product comprising, by weight, less than 0.25% carbon, between 0.20 and 2.0% manganese, between 0.05 and 0.50% silicon, less than 0.01% aluminum, between 0.01% and 0.20% niobuim and between 0.01 and 0.075% nitrogen, having a majority of the microstructure comprised of bainite and acicular ferrite and having yield strength between 650 MPa and 800 MPa and tensile strength between 750 MPa and 900 MPa.

Alternatively or additionally, the niobium content of the nitrided age hardened steel product may be less than 0.1% by weight. The nitrogen content may be between 0.035 and 0.065% by weight or alternatively may be between 0.045 and 0.065% by weight.

The nitrided age hardened steel product may have a yield strength on at least 40% greater than a similar steel composition without nitriding. Alternatively or additionally, the nitrided age hardened steel product may have a tensile strength of at least 30% greater than a similar steel composition without nitriding. The yield strength may be between 650 MPa and 750 MPa, and the tensile strength may be between 750 MPa and 850 MPa.

The nitrided age hardened steel product may have a total elongation of less than 25%, and additionally, the total elongation may be at least 1%, or alternatively, at least 6% or at least 10%. Further, the nitrided age hardened steel product may have a thickness in the range from about 0.5 mm to about 2 mm.

The nitrided age hardened steel product may in addition comprise fine oxide particles of silicon and iron distributed through the steel microstructure having an average particle size less than 50 nanometers.

In addition, a method is disclosed for preparing nitrided thin cast steel strip comprising the steps of:

assembling internally a cooled roll caster having laterally positioned casting rolls forming a nip between them, and forming a casting pool of molten steel supported on the casting rolls above the nip and confined adjacent the ends of the casting rolls by side dams, counter rotating the casting rolls to solidify metal shells on the casting rolls as the casting rolls move through the casting pool, forming from the metal shells downwardly through the nip between the casting rolls a steel strip, and cooling the steel strip at a rate of at least 10° C. per second, coiling the cast strip and nitriding the steel strip to provide a composition comprising by weight, less than 0.25% carbon, between 0.20 and 2.0% manganese, between 0.05 and 0.50% silicon, less than 0.01% aluminum, between 0.01% and 0.20% niobium, and between 0.01 and 0.075% nitrogen, and having a majority of the microstructure comprised of bainite and acicular ferrite, having more than 70% niobium in solid solution prior to nitriding and having yield strength between 650 MPa and 800 MPa and tensile strength between 750 MPa and 900 MPa. The nitriding process may be selected from the group consisting of salt bath nitriding, gas nitriding, and plasma nitriding. Alternatively or additionally, other nitriding process known to one of ordinary skill in the art are also contemplated.

The steel strip as coiled may have fine oxide particles of silicon and iron distributed through the steel microstructure having an average precipitate size less than 50 nanometers.

The method of preparing nitrided thin cast steel strip may further comprise the steps of:

hot rolling the steel strip; and coiling the hot rolled steel strip at a temperature between about 450 and 700° C.

Alternatively or additionally, the hot rolled steel strip may be coiled at a temperature less than 650° C.

Also disclosed is a method of preparing a nitrided thin cast steel strip comprising the steps of:

assembling internally a cooled roll caster having laterally positioned casting rolls forming a nip between them, and forming a casting pool of molten steel supported on the casting rolls above the nip and confined adjacent the ends of the casting rolls by side dams, counter rotating the casting rolls to solidify metal shells on the casting rolls as the casting rolls move through the casting pool, and forming steel strip from the metal shells cast downwardly through the nip between the casting rolls, cooling the steel strip at a rate of at least 10° C. per second coiling the cast strip and nitriding the steel strip to provide a composition comprising by weight, less than 0.25% carbon, between 0.20 and 2.0% manganese, between 0.05 and 0.50% silicon, less than 0.01% aluminum, between 0.01% and 0.20% niobium, and between 0.01 and 0.075% nitrogen, and having a majority of the microstructure comprised of bainite and acicular ferrite, having more than 70% niobium in solid solution prior to nitriding and having yield strength between 650 MPa and 800 MPa and tensile strength between 750 MPa and 900 MPa, and age hardening the steel strip before or after nitriding at a temperature between 625° C. and 800° C. The nitriding process may be selected from the group consisting of salt bath nitriding, gas nitriding, and plasma nitriding.

The steel strip as coiled may have fine oxide particles of silicon and iron distributed through the steel microstructure having an average precipitate size less than 50 nanometers.

The age hardened steel strip may have niobium carbonitride particles with an average particle size of 10 nanometers or less. Alternatively or additionally, the age hardened steel strip may have substantially no niobium carbonitride particles greater than 50 nanometers.

The method of preparing nitrided thin cast steel strip may further comprise the steps of:

hot rolling the steel strip; and coiling the hot rolled steel strip at a temperature less than 700° C.

Alternatively or additionally, the hot rolled steel strip may be coiled at a temperature less than 650° C.

Additionally, the step of age hardening occurs at a temperature between 650° C. and 750° C.

BRIEF DESCRIPTION OF THE DRAWINGS

In order that the invention may be described in more detail, some illustrative examples will be given with reference to the accompanying drawings in which.

DETAILED DESCRIPTION OF THE DRAWINGS

The following description of the embodiments is in the context of high strength thin cast strip with microalloy additions made by continuous casting steel strip using a twin roll caster. The embodiments described herein are not limited to the use of twin roll casters and extends to other types of continuous strip casters.

Figure 1:
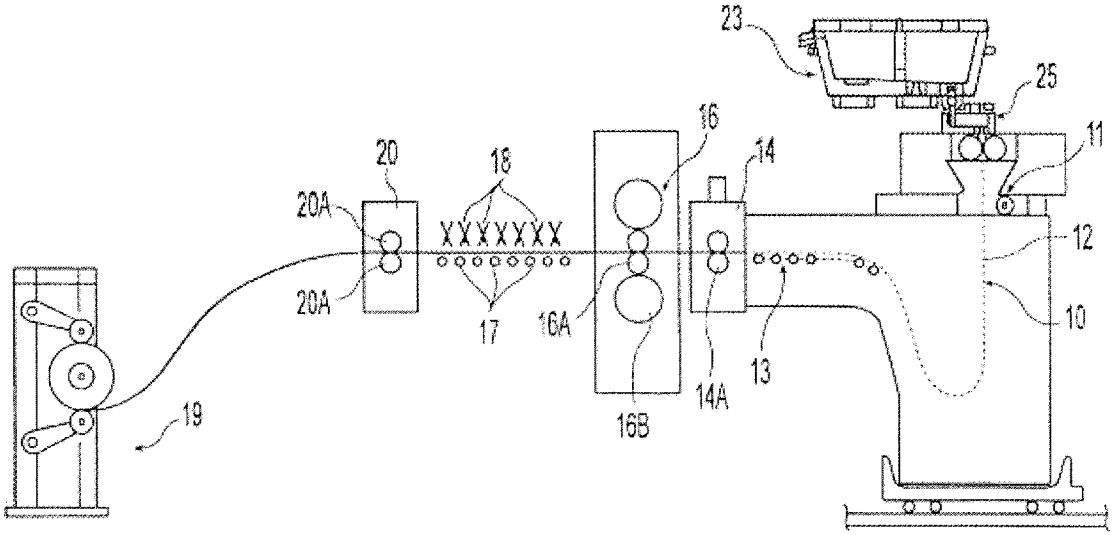
FIG. 1 illustrates a strip casting installation incorporating an in-line hot rolling mill and coiler.
Figure 2:
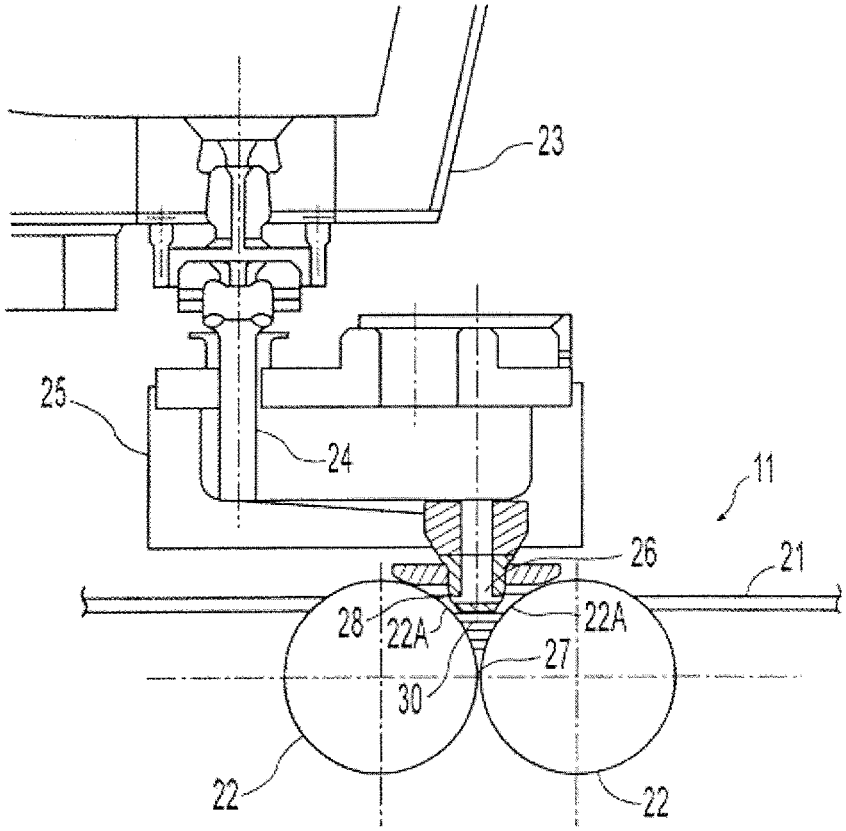
FIG. 2 illustrates details of the twin roll strip caster.

FIG. 1 illustrates successive parts of strip caster for continuously casting steel strip. FIGS. 1 and 2 illustrate a twin roll caster 11 that continuously produces a cast steel strip 12, which passes in a transit path 10 across a guide table 13 to a pinch roll stand 14 having pinch rolls 14A. Immediately after exiting the pinch roll stand 14, the strip passes into a hot rolling mill 16 having a pair of reduction rolls 16A and backing rolls 16B where the cast strip is hot rolled to reduce a desired thickness. The hot rolled strip passes onto a run-out table 17 where the strip may be cooled by convection and contact with water supplied via water jets 18 (or other suitable means) and by radiation. The rolled and cooled strip is then passes through a pinch roll stand 20 comprising a pair of pinch rolls 20A and then to a coiler 19. Final cooling of the cast strip takes place after coiling.

As shown in FIG. 2, twin roll caster 11 comprises a main machine frame 21 which supports a pair of laterally positioned casting rolls 22 having casting surfaces 22A. Molten metal is supplied during a casting operation from a ladle (not shown) to a tundish 23, through a refractory shroud 24 to a distributor or moveable tundish 25, and then from the tundish 25 through a metal delivery nozzle 26 between the casting rolls 22 above the nip 27. The molten metal delivered between the casting rolls 22 forms a casting pool 30 above the nip. The casting pool 30 is restrained at the ends of the casting rolls by a pair of side closure dams or plates 28, which are pushed against the ends of the casting rolls by a pair of thrusters (not shown) including hydraulic cylinder units (not shown) connected to the side plate holders. The upper surface of casting pool 30 (generally referred to as the "meniscus" level) usually rises above the lower end of the delivery nozzle so that the lower end of the delivery nozzle is immersed within the casting pool 30. Casting rolls 22 are internally water cooled so that shells solidify on the moving roller surfaces as they pass through the casting pool, and are brought together at the nip 27 between them to produce the cast strip 12, which is delivered downwardly from the nip between the casting rolls.

The twin roll caster may be of the kind which is illustrated and described in some detail in U.S. Pat. Nos. 5,184,668 and 5,277,243 or U.S. Pat. No. 5,488,988. Reference may be made to those patents for appropriate construction details of a twin roll caster appropriate for use in an embodiment of the present invention.

A high strength thin cast strip product can be produced using the twin roll caster that overcomes the shortcomings of conventional light gauge steel products and produces a high strength, light gauge, low carbon, steel strip product. Low carbon steel here refers to steels having a carbon level below 0.1% by weight. The invention may utilize microalloying elements including niobium, vanadium, titanium or molybdenum or a combination thereof.

Microalloying elements in steel are commonly taken to refer to the elements titanium, niobium, and vanadium. These microalloying elements were usually added in the past in levels below 0.1%, but in some cases levels as high as 0.2%. These microalloying elements are capable of exerting strong effects on the steel microstructure and properties via a combination of hardenability, grain refining and precipitation strengthening effects (in the past as carbonitride formers). Molybdenum has not normally regarded as a microalloying element since on its own it is a relatively weak carbonitride former, but in the present circumstances carbonitdride formation is inhibited in the hot rolled strip with these microalloys as explained below.

The high strength thin cast strip product combines several attributes to achieve a high strength light gauge cast strip product by microalloying with these elements. Strip thicknesses may be less than 3 mm, less than 2.5 mm, or less than 2.0 mm, and may be in a range of 0.5 mm to 2.0 mm. The cast strip is produced by hot rolling without the need for cold rolling to further reduce the strip to the desired thickness. Thus, the high strength thin cast strip product overlaps both the light gauge hot rolled thickness ranges and the cold rolled thickness ranges desired. The strip may be cooled at a rate of 10° C. per second and above, and still form a microstructure that is a majority and typically predominantly bainite.

The benefits achieved through the preparation of such a high strength thin cast strip product are in contrast to the production of previous conventionally produced microalloyed steels which results in relatively high alloy costs, difficulties in hot and cold rolling, and difficulties in recrystallization annealing since conventional continuous galvanizing and annealing lines are not capable of providing the high annealing temperatures needed. Moreover, the relatively poor ductility exhibited with strip made by the cold rolled and recovery annealed manufacturing route is overcome.

The high strength thin cast steel strip product was produced comprising, by weight, less than 0.25% carbon, between 0.20 and 2.00% manganese, between 0.05 and 0.50% silicon, less than 0.01% aluminum, niobium between about 0.01%, and between about 0.01 and 0.075% nitrogen, and having a microstructure comprising a majority bainite and acicular ferrite, having more than 70% niobium in solid solution prior to nitriding. The steel product may further comprising fine oxide particles of silicon and iron distributed through the steel microstructure having an average precipitate size less than 50 nanometers. The steel product may be further comprised of a more uniform distribution of microalloys through the microstructure than previously produced with conventional slab cast product.

After hot rolling, the hot rolled low carbon steel strip may be coiled at a temperature in the range from about 500-700° C. The thin cast steel strip may also be further processed by precipitation hardening the low carbon steel strip to increase the tensile strength at a temperature of at least 550° C. The precipitation hardening may occur at a temperature between 550° C. and 800° C. or more particularly between 675° C. and 750° C. Conventional furnaces of continuous galvanizing or annealing lines are thus capable of providing the precipitation hardening temperatures needed to harden the microalloyed cast strip product.

For example, a steel composition was prepared by making a steel composition of a 0.026% niobium, 0.04% by weight carbon, 0.85% by weight manganese, 0.25% by weight silicon that has been cast by a thin cast strip process. The strip was cast at 1.7 mm thick and inline hot rolled to a range of strip thickness from 1.5 mm to 1.1 mm using a twin roll caster as illustrated in FIGS. 1 and 2. The strip was coiled at coiling temperatures of 590-620° C. (1094-1148° F.).

After coiling, the strip may be subjected to a nitriding process. Alternatively parts may be formed from the strip by stamping or other processes and then nitrided. In one example, nitriding was performed on a 0.084 wt % Nb-microalloyed steel compositions (Nb-steel) made by twin roll casting with the processing parameters and chemical composition (wt. %) which are listed in Table 1. Steel coupons were heated in a $KNO_3$ salt bath at 525° C., followed by water quenching. Such a temperature for the salt bath is typical of nitriding salt baths, which generally employ molten salt or salts between about 500° C. and 600° C. LECO combustion analysis was undertaken to determine the N concentration in all samples. For comparison, Nb-free steel compositions made by twin roll casting were also nitrided, and a nitrogen-free heat treatment (achieved by wrapping steel coupons in Al foil) was also carried out on the Nb-steel. Potassium nitrate ($KNO_3$) starts to decompose at about 500° C. into $K_2O$, $O_2$ and $N_2$, where the $N_2$ is available to diffuse into steel. Higher temperature nitriding at 650° C. is believed to encourage Fe nitride precipitation mainly at grain boundaries and partly within grains.

TABLE 1

| Specimen | HR temp(° C.) | Coil temp(° C.) | Nb | C | Mn | Si | N |
|---|---|---|---|---|---|---|---|
| Nb-free steel | 878.5 | 544 | 0.001 | 0.034 | 0.98 | 0.2 | 0.008 |
| Nb-steel | 897 | 567 | 0.084 | 0.031 | 0.83 | 0.2 | 0.006 |

Alternatively, other nitriding processes known to one of ordinary skill in the steelmaking arts may also be employed within the scope of the disclosure. For example, the strip may be gas nitrided in a furnace at temperatures between about 500° C. and 575° C., where the furnace atmosphere is rich in nitrogen. Typically, such an atmosphere may include ammonia. During the gas nitriding process, the ammonia gas contacts the heated workpiece and dissociates into nitrogen and hydrogen, with the nitrogen diffusing through the surface of the workpiece and into the body of the workpiece. The rate of introduction of nitrogen to the surface of the workpiece is determined by the nitriding potential, which is determined by the concentration of ammonia at the work surface and the rate of ammonia dissociation. As such, computer systems may be used to control the concentration of ammonia in the furnace in order to effect consistent nitriding treatment.

In another alternative, the strip may be treated by plasma nitriding, which is also known as ion nitriding, plasma ion nitriding, and glow-discharge nitriding. In the plasma nitriding process, the workpiece to be treated is placed in a controlled atmosphere, which typically is nitrogen gas, but additionally may include argon and/or hydrogen. Electrical fields are then used to ionize the nitrogen gas, forming a plasma. The plasma impinges on the surface of the workpiece, effectively nitriding the workpiece. The efficiency of the plasma nitriding process is not temperature dependent, and accordingly, plasma nitriding may be conducted over a broader range of temperatures than either salt bath or gas nitriding, from about 250° C. to temperatures in excess of 600° C.

The nitrogen pick-up measured after nitriding is shown in Table 2. Nitrogen in the samples nitrided for 4 and 6 hours are 7.4 and 9.3 times higher than the as-received sample. Also shown in Table 2 are tensile data from the nitrided steels. There is a small drop of total elongation from 14% to 12% after 4 hours. The fracture type still remains ductile. The YS and UTS of the 4 hour nitrided Nb-steel are 52% and 43% higher than those of the as-received steel. Further nitriding (6 hours) causes a dramatic drop in ductility that leads to brittle fracture. The yield strength (YS), ultimate tensile strength (UTS) and total elongation (TE) for each specimen were obtained using standard tensile testing.

TABLE 2

| Nitriding time (h) | N (wt %) | YS (MPa) | UTS (MPa) | TE (%) |
|---|---|---|---|---|
| 0 | 0.006 | 475.9 ± 1.7 | 557.1 ± 4.7 | 14.2 ± 2.3 |
| 1 | 0.025 | 600.0 ± 2.3 | 673.0 ± 2.6 | 11.7 ± 0.2 |
| 4 | 0.059 | 722.0 ± 1.4 | 797.5 ± 4.9 | 12.5 ± 0.5 |
| 6 | 0.072 | 764 | 822 | 5 |

Figure 3:
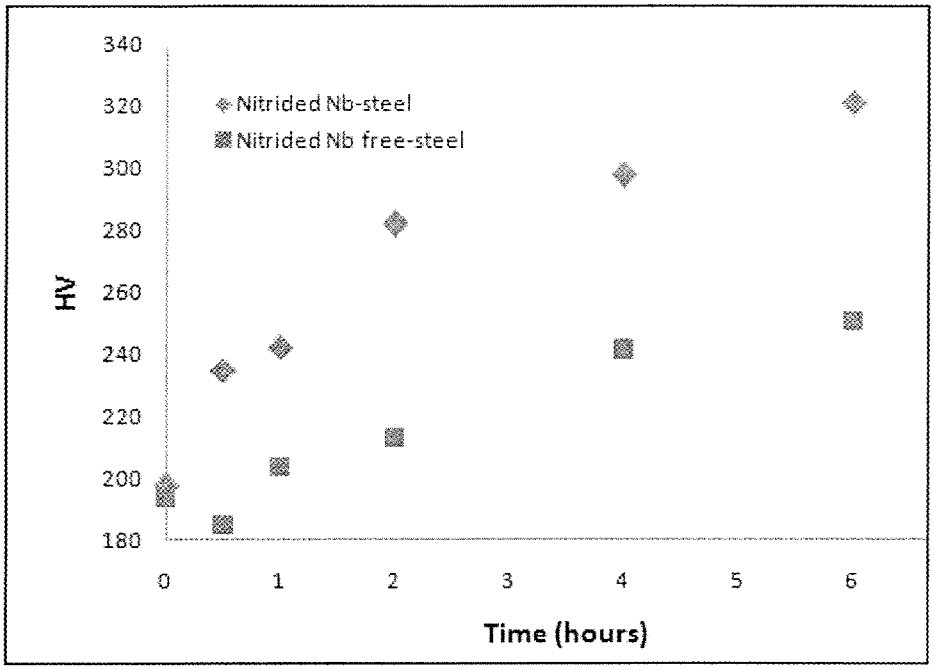
FIG. 3 illustrates the effect of nitriding time on strip hardness with and without microalloy additions.

Referring now to FIG. 3, the hardness profiles show increased hardening for Nb-steel as the duration of nitriding increases. To a lesser extent, surface hardening was also observed with increased nitriding time in the Nb-free steel. Hardness was measured using a Vickers micro-hardness indenter with a load of 5 kg for the surface measurements and 1 kg for the through thickness measurements.

Figure 4:
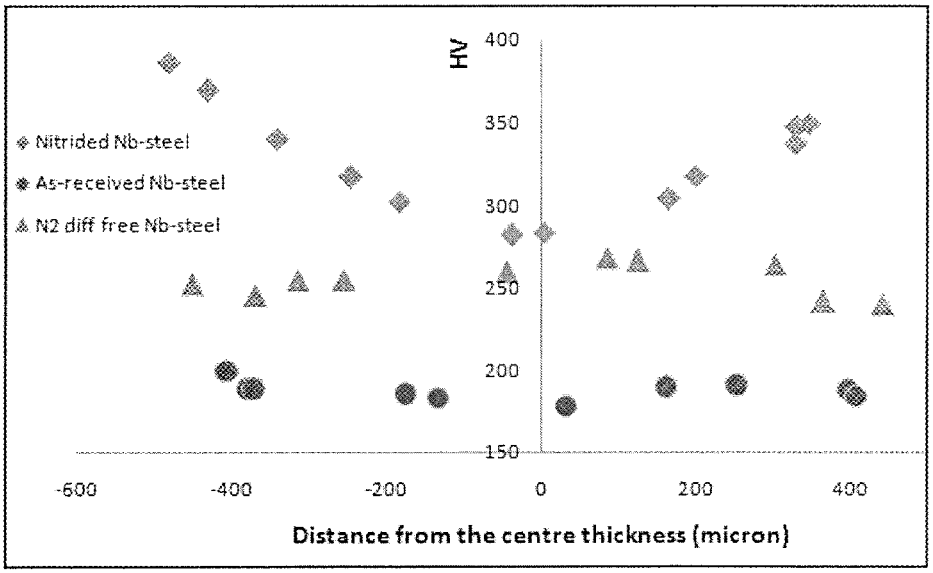
FIG. 4. illustrates the hardness profile on nitrided microalloy steel, heat treated microalloy steel, and the same microalloy steel in the as-received condition

FIG. 4 shows hardness profiles of 4 hour-nitrided Nb-steel, 4 hour-heat-treated Nb-steel without nitrogen diffusion and the same Nb-steel as received in the thickness direction. The hardness of the as-received and the nitrogen diffusion-free samples are uniform across the thickness, while the heat-treated sample is harder. The nitrided Nb-steel is harder towards the surfaces and softer near the center, and the hardness near the center is only slightly higher than that of nitrogen-diffusion-free aged steel.

Figure 5A:
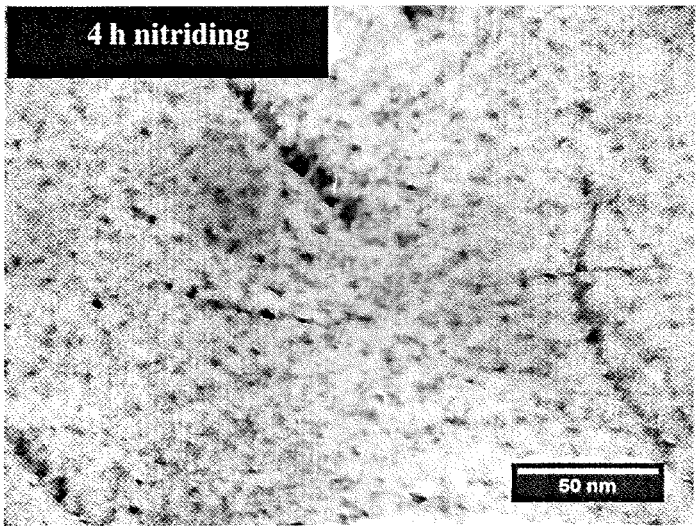
FIG. 5*a* is an optical micrograph of a microalloyed steel strip nitrided for four hours.
Figure 5B:
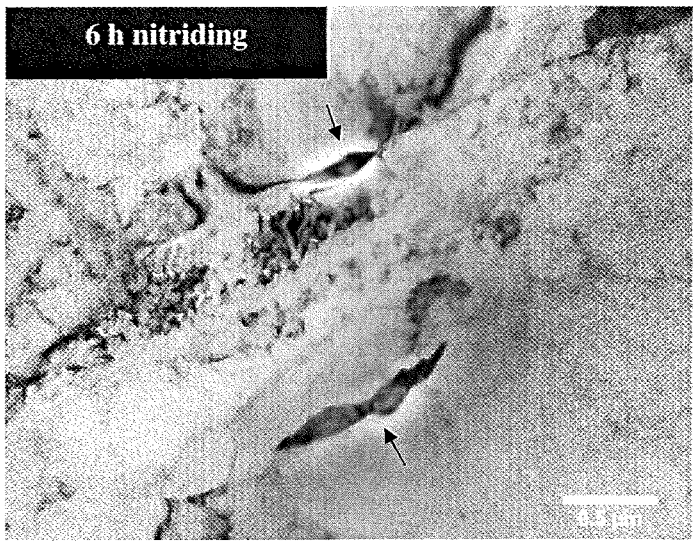
FIG. 5*b* is an optical micrograph of a microalloyed steel strip nitrided for six hours.

Turning now to FIGS. 5*a*-*b*, transmission electron microscopy (TEM) studies were carried out using a JEOL 2100 at 200 kV. All TEM specimens were prepared from the center of the steel sheets in the thickness direction. FIG. 5*a* shows precipitates in the Nb-steel nitrided for 4 hours, while FIG. 5*b* shows coarse grain boundary precipitates in the Nb-steel nitrided for 6 hours. TEM observations revealed a very fine, speckled contrast after nitriding for 4 to 6 hours, indicating a dispersion of very fine precipitates in the 4 hour sample. Additionally, the specimens nitrided for 6 hours also contained coarse features along grain boundaries. These features were occasionally found in the 4 hour nitrided steel but less frequently than in the 6 hour nitrided specimens. No such features were noticed in the as-received steels.

Figure 6A:
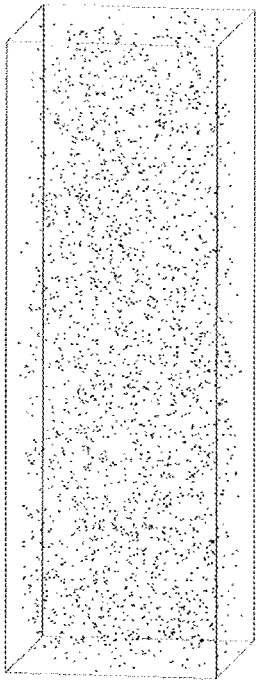
FIGS. 6*a-c* illustrate atom probe data showing the dispersion of precipitates in specimens as received, after four hour nitriding treatment, and after six hour nitriding treatment, respectively.
Figure 6B:
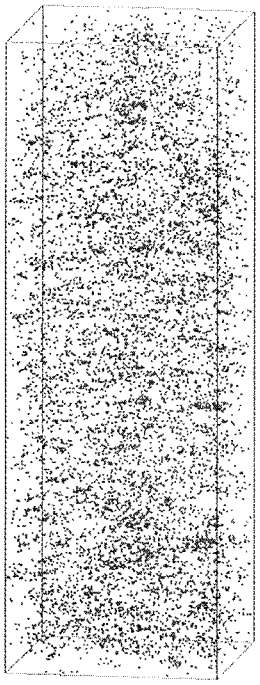
Figure 6C:
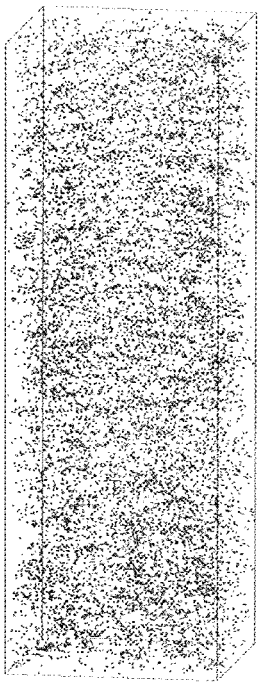

Atom probe tomography (APT) work was performed with a Local Electrode Atom Probe (LEAP) at ~25 K with a pulse fraction of 25%, a flight path of 90 mm and a pulse repetition rate of 200 kHz. APT data were reconstructed using the method described in B. Gault, M. P. Moody, F. de Geuser, G. Tsafnat, A. La Fontaine, L. T. Stephenson, D. Haley, S. P. Ringer, Journal of Applied Physics 105 (2009). All APT specimens were prepared from the center of the steel sheets in the thickness direction. Similar to the results found by TEM analysis, atom probe tomography also showed a dispersion of fine precipitates in the specimens nitrided for 4 hours and 6 hours, as shown in FIGS. 6*b* and 6*c*, respectively. Precipitates were observed along dislocations as well as in the matrix. No Nb-rich precipitates were found in atom probe data from the as-received steel, as shown in FIG. 6*a*. There were also noticeable $(NbN)^{3+}$ and $(NbN)^{2+}$ clusters present in 4 and 6 hour-nitrided Nb-steels.

While the invention has been illustrated and described in detail in the foregoing drawings and description, the same is to be considered as illustrative and not restrictive in character, it being understood that only illustrative embodiments thereof have been shown and described, and that all changes and modifications that come within the spirit of the invention described by the following claims are desired to be protected. Additional features of the invention will become apparent to those skilled in the art upon consideration of the description. Modifications may be made without departing from the spirit and scope of the invention.

What is claimed is:

1. A nitrided thin cast coiled steel strip comprising, by weight, less than 0.25% carbon, between 0.20 and 2.0% manganese, between 0.05 and 0.50% silicon, less than 0.01% aluminum, niobium between 0.01 and about 0.20%, and between 0.01 and 0.075% nitrogen, and having a majority of the microstructure comprised of bainite and acicular ferrite, having more than 70% niobium in solid solution prior to nitriding and having a yield strength between about 600 MPa and about 722 MPa, a tensile strength between about 673 MPa and about 797 MPa, a total elongation of at least 10% where the steel strip is less than 3 mm in thickness and has fine oxide particles of silicon and iron distributed through the steel microstructure having an average particle size less than 50 nanometers, and having nitrogen from nitriding diffused throughout the entire strip thickness.

2. The nitrided steel strip as claimed in claim 1 where the niobium is less than 0.1%.

3. The nitrided steel strip as claimed in claim 1 where the nitrided steel strip has a tensile strength of at least 30% greater than without nitriding.

4. The nitrided steel strip as claimed in claim 1 where the nitrogen is between 0.035 and 0.065%.

5. The nitrided steel strip as claimed in claim 1 where the nitrogen is between 0.045 and 0.065%.

6. The nitrided steel strip as claimed in claim 1 where the nitrided steel strip has a total elongation of less than 25% than without nitriding.

7. The nitrided steel strip as claimed in claim 1 where the strip has a total elongation of at least 10%.

8. The nitrided steel strip as claimed in claim 1 where the steel strip is hot rolled.

9. The nitrided steel strip as claimed in claim 1 where the total elongation is between 12.0% and 16.5%.

10. The nitrided steel strip as claimed in claim 1 where the steel strip is less than 2.5 mm in thickness.

11. The nitrided steel strip as claimed in claim 1 where the steel strip is less than 2.0 mm in thickness.

12. A nitrided thin cast steel strip comprising, by weight, less than 0.25% carbon, between 0.20 and 2.0% manganese, between 0.05 and 0.50% silicon, less than 0.01% aluminum, niobium between 0.01 and about 0.20%, and between 0.01 and 0.075% nitrogen, and having a majority of the microstructure comprised of bainite and acicular ferrite, having more than 70% niobium in solid solution prior to nitriding and having yield strength between about 600 MPa and about 722 MPa, and tensile strength between about 673 MPa and about 797 MPa where the steel strip is less than 3 mm in thickness, and having nitrogen from nitriding diffused throughout the entire strip thickness.

13. The nitride steel strip as claimed in claim 1 having a nitrogen pick-up rate from nitriding of between 7.4 and 9.3 times.

14. The nitride thin cast steel strip of claim 12 having a nitrogen pick-up rate from nitriding of between 7.4 and 9.3 times.

* * * * *